US005192653A

United States Patent [19]

Tani

[11] Patent Number: 5,192,653

[45] Date of Patent: Mar. 9, 1993

[54] METHOD FOR SPECTRALLY SENSITIZING SILVER HALIDE PHOTOGRAPHIC EMULSIONS

[75] Inventor: Tadaaki Tani, Kanagawa, Japan

[73] Assignee: Fuji Photo Film Co., Ltd., Kanagawa, Japan

[21] Appl. No.: 840,588

[22] Filed: Feb. 26, 1992

Related U.S. Application Data

[63] Continuation of Ser. No. 468,512, Jan. 23, 1990, abandoned.

[30] Foreign Application Priority Data

Jan. 23, 1989 [JP] Japan ..... 1-13377

[51] Int. Cl.[5] ..... G03C 1/015; G03C 1/12

[52] U.S. Cl. ..... 430/569; 430/570; 430/572; 430/573; 430/611

[58] Field of Search ..... 430/569, 570, 572, 573, 430/611

[56] References Cited

U.S. PATENT DOCUMENTS

| | | | |
|---|---|---|---|
| 3,457,078 | 7/1969 | Riester | 430/611 |
| 4,097,284 | 6/1978 | Tani | 430/603 |
| 4,332,888 | 6/1982 | Corben | 430/569 |
| 4,603,104 | 7/1986 | Philip, Jr. | 430/572 |
| 4,693,965 | 9/1987 | Ihama et al. | 430/569 |
| 4,879,208 | 11/1989 | Urabe | 430/569 |
| 4,894,323 | 1/1990 | Kawai et al. | 430/569 |

OTHER PUBLICATIONS

Mess, *The Theory of the Photographic Process*, 3rd Ed. 1966, Macmillan Co. pp. 250–251.

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A method for spectrally sensitizing silver halide emulsions is disclosed, comprising the step of adding a cyanine dye, which provides a J-band when added to silver halide emulsions, to a silver halide emulsion followed by ripening with such conditions that the relative quantum yield $\phi_r$ of spectral sensitization assumes a value of ½ or less of the $\phi_r$ of spectral sensitization obtained when the dye is added to the emulsion under ripening conditions of 40° C. and 20 minutes from the time of addition of the dye to the emulsion until the time of coating the emulsion, and then ripening the silver halide emulsions. In one embodiment of the disclosed method, a heterocyclic compound which contains a mercapto group is added to the emulsion before the addition of the dye in an amount sufficient to increase the $\phi_r$.

11 Claims, No Drawings

METHOD FOR SPECTRALLY SENSITIZING SILVER HALIDE PHOTOGRAPHIC EMULSIONS

This is a continuation of application Ser. No. 07/468,512 filed Jan. 23, 1990, now abandoned.

FIELD OF THE INVENTION

The present invention relates to an improved method for spectrally sensitizing silver halide photographic emulsions.

BACKGROUND OF THE INVENTION

In the production technology for silver halide photographic emulsions, there is a need to increase the sensitivity of photographic emulsions. Chemical sensitization and spectral sensitization are known as useful methods for increasing the sensitivity of silver halide photographic emulsions.

Spectral sensitization is a technique in which the sensitivity of a photographic emulsion is increased by including a sensitizing dye in the silver halide photographic emulsion and thereby expanding the sensitive wavelength region of the silver halide photographic emulsion, which had been limited to the shorter wavelength region of visible light, into longer wavelength regions. Cyanine dyes and the like are the principal sensitizing dyes, though many other sensitizing dyes and methods for using these are also known.

In general, spectrally sensitizing dyes are added to an emulsion which has undergone chemical ripening prior to coating. Methods in which they are added to the emulsion prior to the start of or during chemical ripening are disclosed, for example, in U.S. Pat. No. 4,425,426. Furthermore, methods in which the spectral sensitizing dye is added to the emulsion before the formation of the silver halide grains has been completed are disclosed in U.S. Pat. Nos. 2,735,766, 3,628,960, 4,183,756 and 4,225,666.

In particular, U.S. Pat. Nos. 4,183,756 and 4,225,666 disclose that adding the spectral sensitizing dye to the emulsion after the formation of a stable nucleus during silver halide grain formation gives advantages such as an increase in the photographic speed and a strengthening in the adsorption of the spectral sensitizing dye by the silver halide grains. Furthermore, JP-A-61-133941 and JP-A-61-160739 (the term "JP-A" as used herein refers to a "published unexamined Japanese patent application") disclose a method of spectral sensitization in that the chemical sensitization is carried out in the presence of a spectral sensitizing dye.

Thus, the methods of adding spectral sensitizing dyes have diversified in recent years and have come to show such features as a strengthening in the adsorption of the sensitizing dye by the silver halide grains when compared with conventional addition methods and the chemical sensitization site has been focused (i.e., the chemical sensitization site is carried out at only the specific place).

It is well known that heterocyclic compounds having mercapto groups are effective as antifoggants for photographic emulsions, while it is also known that compounds such as these reduce the sensitivity of a photographic emulsion. This is described on pages 344 to 346 of Volume 3 of *The Theory of the Photographic Process* edited by C. E. K. Mees and T. H. James.

On the other hand, JP-A-51-77224 discloses that if a heterocyclic compound having a mercapto group is included together with a trimethine cyanine sensitizing dye in the silver halide emulsion after chemical sensitization has been completed, the spectral sensitization action of the cyanine dye is strengthened. Moreover, JP-A-51-36130 discloses that heterocyclic compounds having mercapto groups increase the intrinsic sensitivity of silver halide emulsions in which the majority of the silver halide is composed of either silver bromide or silver chloride and in which the silver halide grains have a cubic crystal form.

JP-A-49-64419 discloses that the spectral sensitization action of a cyanine dye having a pyridine nucleus in at least one of the two hetero nuclei, in other words a pyridinocyanine dye (or a pyridocyanine dye), is increased by using, in combination with the dye, certain types of mercapto compounds having acid groups.

As described above, there have been disclosures of several spectral sensitization methods such as the method of adding the spectral sensitizing dye to an emulsion or combining it with a heterocyclic compound having a mercapto group. But there remain many points for improvement in the strength of adsorption of the sensitizing dye by the silver halide grains and for improvement in chemical sensitization and/or high efficiency of the spectral sensitization.

It is known that some cyanine dyes form J-aggregates when they are added to silver halide emulsions and display an absorption band known as a J-band. The features of the J-band, which is contrasted with the M-band produced by the dye monomer, are that the $\lambda max$, the maximum absorption wavelength, is longer than that for the M-band, it is sharper (the half-value width is narrower). These features are indispensable for providing the color sensitivity for a color photographic material. There is no means for directly measuring the size of a J-aggregate but, by reference to theory, A. E. Rosenoff, K. S. Norland, A. E. Ames, V. K. Walworth, G. R. Bird et al. have indicated in *Photogr. Sci. Eng.*, Vol. 12, No. 4, p. 185 (1968), it is possible to estimate that the J-aggregate is larger the longer the wavelength of the $\lambda max$ of the J-band or the narrower the half-value width.

As a result of diligent study into methods of spectral sensitization, the present inventors have discovered that by using cyanine dyes which form a J-band when added to a silver halide emulsion and carrying out ripening by adding these dyes to the emulsion under conditions such that the relative quantum yield $\phi_r$ of spectral sensitization assumes a value for $\phi_r$ in the emulsion which is $\frac{1}{2}$ or less and more preferably $\frac{1}{3}$ or less of the value obtained when the ripening conditions from the time when the dye is added to the same emulsion until the time of coating are 40° C., 20 minutes, an increase in the stability of the photosensitive material is obtained due to the strong adsorption of the dye onto the silver halide and an increase in the performance of the photosensitive material such as the reciprocity characteristic is obtained due to an improvement in the chemical ripening process upon the addition of the dye.

Moreover, they have discovered that the $\phi_r$ is markedly improved and photosensitive materials of a high sensitivity are obtained by adding heterocyclic compounds having mercapto groups to the emulsion prior to the addition of the dye under the conditions described above.

SUMMARY OF THE INVENTION

An object of the present invention is to obtain a novel method for spectrally sensitizing silver halide photographic emulsions.

A second object of the present invention is to obtain a novel method for spectrally sensitizing silver halide photographic emulsions, which provides photosensitive materials having an improved stability and reciprocity characteristic.

A second object of the present invention is to obtain a novel method for spectrally sensitizing silver halide photographic emulsions, which provides silver halide photosensitive materials having improved stability and reciprocity characteristics and a high relative quantum yield $\phi_r$ of spectral sensitization.

The various above-mentioned objects of the present invention are achieved by using a cyanine dye which provides a J-band in the emulsion when spectrally sensitizing a silver halide photographic emulsion, and carrying out ripening by adding the dye to the emulsion under conditions such that the relative quantum yield $\phi_r$ of spectral sensitization is such that the $\phi_r$ in the emulsion is ½ or less and more preferably ⅓ or less of the value obtained when the ripening conditions, from the time when the dye is added to the same emulsion until the time of coating are 40° C., 20 minutes, and further preferably by adding to the emulsion a heterocyclic compound having a mercapto group in an amount and under conditions sufficient to increase the $\phi_r$ prior to the addition of the dye in the method described above.

DETAILED DESCRIPTION OF THE INVENTION

A J-band is an absorption band which is shown when cyanine dye molecules form J-aggregates. Information concerning cyanine dye J-bands is described in *The Theory of the Photographic Process*, Vol. 4, 1977, Macmillan Publishing Co., Ltd., pages 218 to 222, edited by T. H. James. Furthermore, it is described in *Studies of the Adsorption of Photographic Sensitizing and Desensitizing Dyes to Silver Bromide Grains on the Basis of Their Visible and Infrared Spectra*, by Tadaaki Tani and S. Kikuchi, Bulletin of the Society of Scientific Photography of Japan, No. 17, 1 to 11 (1967) that the wave number $\nu$ max of the absorption peak of a cyanine dye which has not formed on an aggregate varies in accordance with the McRae formula depending upon the solvent and the optical permittivity (given by 2 to the power of $n^2$ of the refractive index) of the adsorbing medium. The characteristics of a J-band are that the wave number $\nu$ max of the absorption peak is smaller than the $\nu$ max derived from the McRae formula (which is to say the wavelength of the absorption peak is long) and that the absorption band is sharp (in other words the half-value width is narrow). As a criterion, an absorption band with a small half-value width and where the $\nu$ max is at least 1,500 $cm^{-1}$ smaller than the absorption band in ethanol can be considered as a J-band. Furthermore, the J-band of a cyanine dye in an emulsion can be easily discerned since it weakens and becomes smaller if large amounts of 4-hydroxy-6-methyl-1,3,3a,7-tetraazaindene (TAI) are added.

The spectral sensitization efficiency $\phi_r$ can be measured in accordance with the method described by J. Spence and B. H. Carroll in *J. Phys. Colloid Chem.*, 52, 1090 (1948) or by T. Tani and H. Urabe in the *Journal of the Photographic Society of Japan*, Vol. 41, 325 (1978).

Dyes represented by formula (I) are included among the cyanine dyes which form J-aggregates in an emulsion and are used in the present invention.

$$R^1-N\overset{Z^1}{\langle}(CH=CH)_m C\overset{Z^1}{\rangle}=CH-C\overset{R^0}{\underset{|}{\rangle}}CH-C\overset{Z^2}{\langle}=CH-CH\overset{Z^2}{\rangle}_n N^{\oplus}-R^2 \quad (I)$$

$$(X^{\ominus})_p$$

In formula (I), $Z^1$ and $Z^2$ are identical or different and each represents groups of atoms necessary to complete a 5-membered or 6-membered nitrogen-containing heterocyclic ring normally used for cyanine dyes. Examples of the above mentioned heterocyclic ring includes a thiazoline ring, a pyrroline ring, an oxazole ring, a thiazole ring, a selenazole ring, an imidazole ring, a tetrazole ring and the like. In addition, they also include nuclei formed by condensing a benzene ring or a naphthalene ring onto these rings which is to say the indolenine nucleus, benzindolenine nucleus, benzoxazole nucleus, naphthoxazole nucleus, benzothiazole nucleus, naphthothiazole nucleus, benzoselenazole nucleus, naphthoselenazole nucleus, benzimidazole nucleus, naphthoimidazole nucleus and the like. However, dyes of the type where the heterocyclic rings completed by the groups of atoms represented respectively by $Z^1$ and $Z^2$ are both indolenine nuclei or benzindolenine nuclei (unsubstituted or substituted) are not used in the present invention.

These heterocyclic rings may be substituted by alkyl groups with up to 4 carbon atoms, alkoxy groups, aryl groups, aralkyl groups, hydroxyalkyl groups, carboxyalkyl groups, alkoxycarbonylalkyl groups, halogen atoms, carboxy groups, sulfo groups, trifluoromethyl groups, alkoxycarbonyl groups (up to 4 carbon atoms in the alkyl moiety), cyano groups, hydroxyl groups, alkylamino groups and the like. Furthermore, an aliphatic hydrocarbon chain (for example, a trimethylene chain or a tetramethylene chain) may be bonded to form a condensed ring, for example, a thiazole nucleus (for example, thiazole, 4-methylthiazole, 4-phenylthiazole, 4,5-dimethylthiazole and 4,5-diphenylthiazole); benzothiazole nucleus (for example, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole and 5-phenylbenzothiazole); naphthothiazole nucleus (for example, naphtho[2,1-d]thiazole, naphtho[1,2-d]thiazole, naphtho[2,3-d]thiazole, 5-methoxynaphtho[1,2-d]thiazole, 8-methoxynaphtho[2,1-d]thiazole and 5-methoxy[2,3-d]thiazole); thiazoline nucleus (for example, thiazoline and 4-methylthiazoline); oxazole nucleus (for example, oxazole, 4-methyloxazole and 4-ethyloxazole); benzoxazole nucleus (for example, benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluoromethylbenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole and 5-ethoxybenzoxazole); naphthoxazole nucleus (for example, naphtho[2,1-d]oxazole, naphtho[1,2-d]oxazole, naphtho[1,2-d]oxazole, and naphtho[2,3-d]oxazole); selenazole nucleus (for example, 4-methylselenazole and 4-phenylselenazole); benzoselenazole nucleus (for example, benzoselenazole, 5-chlorobenzoselenazole, 5-methoxybenzoselenazole, 5-methylbenzoselenazole and 5-hydroxybenzoselenazole); naphtoselenazole nucleus (for example, naphtho[2,1-d]selenazole and naphtho[1,2-d]selenazole); 3,3-dialkylindolenine nucleus (for example, 3,3-dimethylindolenine, 3,3-diethylindolenine, 3,3-dimethyl-5-cyanoindolenine, 3,3-dimethyl-5-methoxyindolenine, 3,3-dimethyl-5-methylindolenine and 3,3-dimethyl-5-chloroindolenine); imidazole nucleus (for example, 1-methylimidazole, 1-ethylimidazole, 1-methyl-4-phenylimidazole and 1-ethyl-4-phenylimidazole); benzimidazole nucleus (for example, benzimidazole, 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-ethyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-methyl-5-trifluoromethylbenzimidazole, 1-ethyl-5-trifluoromethylbenzimidazole, 1-allyl-5,6-dichlorobenzimidazole, 1-allyl-5-chlorobenzimidazole, 1-phenylimidazole, 1-phenylbenzimidazole, 1-phenyl-5-chlorobenzimidazole, 1-phenyl-5,6-dichlorobenzimidazole, 1-phenyl-5-methoxybenzimidazole and 1-phenyl-5-cyanobenzimidazole); naphthoimidazole nucleus (for example, 1-ethylnaphtho[1,2-d]imidazole and 1-phenylnaphtho[1,2-d]imidazole); tetrazole nucleus (for example, 1,3-dimethyltetrazole, 1-methyl-3-ethyltetrazole).

$R^0$ represents a hydrogen atom, an alkyl group with up to 4 carbon atoms (for example, methyl, ethyl, propyl), a hydroxyalkyl group (for example, β-hydroxyethyl), a carboxyalkyl group (for example, β-carboxyethyl), a cyano group, an aralkyl group (for example, phenethyl), a phenyl group, a substituted phenyl group (for example, o-carboxyphenyl group) or the like.

In formula (I), m, n and p each represents integers of generally 0 or 1 and preferably 0. $R^1$ and $R^2$ each represents aliphatic groups or aromatic groups with 1 to 8 carbon atoms. The carbon chain in the aliphatic group may be interrupted by oxygen atoms, sulfur atoms or nitrogen atoms or a part thereof may form a ring. Both the aliphatic groups and the aromatic groups may have substituent groups. For example, this $R^1$ and $R^2$ each represents an unsubstituted alkyl group with 1 to 8 carbon atoms (for example, methyl, ethyl, n-propyl, hexyl); a substituted alkyl group (preferably one with 1 to 4 carbon atoms in the alkyl radical (moiety), for example, a vinylmethyl group), an aralkyl group (for example, benzyl or phenethyl), a hydroxypropyl group (for example, 2-hydroxyethyl, 3-hydroxypropyl and 4-hydroxybutyl), an acetoxyalkyl group (for example, 2-acetoxyethyl, 3-acetoxypropyl), an alkoxyalkyl group (for example, 2-methoxyethyl, 4-methoxybutyl), a sulfatoalkyl group (for example, 3-sulfatopropyl and 4-sulfatobutyl), alkyl groups containing carboxyl groups (for example, 2-carboxyethyl, 3-carboxypropyl, 2-(2-carboxyethoxy)ethyl and p-carboxybenzyl), alkyl groups containing sulfo groups (for example, 2-sulfoethyl, 3-sulfopropyl, 3-sulfobutyl, 4-sulfobutyl, 2-hydroxy-3-sulfopropyl, 2-(3-sulfopropoxy)ethyl, 2-acetoxy-3-sulfopropyl, 3-methoxy-2-(3-sulfopropoxy)propyl, 2-[2-(3-sulfopropoxy)ethoxy]ethyl, 2-hydroxy-3-(3'-sulfopropoxy)propyl, p-sulfophenethyl and p-sulfobenzyl) or an aryl group (for example, phenyl, p-tolyl).

$X^{\ominus}$ represents an inorganic or organic acid anion which forms a salt with the dye, for example, a chloride ion, a bromide ion, an iodide ion, a perchlorate ion, a p-toluenesulfonic acid ion or the like. When the dye forms an intramolecular salt, it also represents 1.

l is 0, 1 or 2, preferably 0 or 1 and more preferably 1.

Of the cyanine dyes represented by formula (I) used in the present invention, the dyes represented by the following formula are particularly useful.

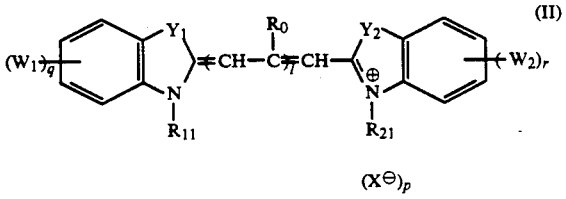

(II)

In formula (II), $Y_1$ and $Y_2$ represent sulfur atoms, selenium atoms or oxygen atoms. $R_{11}$ and $R_{21}$ each represents alkyl groups, hydroxyalkyl groups, carboxyalkyl groups, sulfoalkyl groups or sulfoalkoxyalkyl groups. $W_1$ and $W_2$ each represents an alkyl group with 1 to 4 carbon atoms, a phenyl group, a condensed benzene ring, an aralkyl group, an alkoxy group with 1 to 4 carbon atoms, a hydroxyl group, a halogen atom, a cyano group, a carboxy group, an alkoxycarbonyl group (with up to 4 carbon atoms in the alkyl moiety) or a trifluoromethyl group. q and r each represents an integer of generally from 0 to 4 and preferably from 0 to 2. l, $R_0$, $X^{\ominus}$ and p have the same meaning as in formula (I).

Of these dyes, those which are preferred in the present invention are the dyes represented by the following formulae (III) to (VIII).

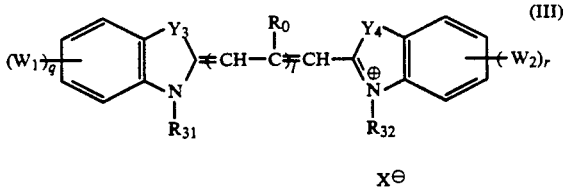

(III)

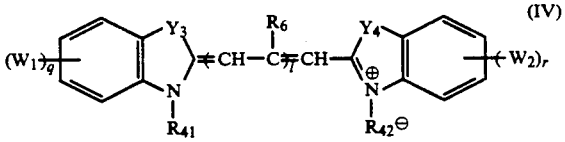

(IV)

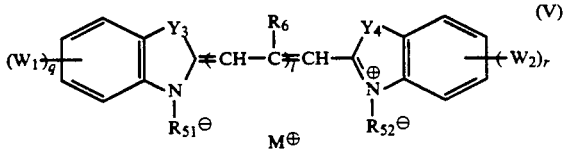

(V)

-continued

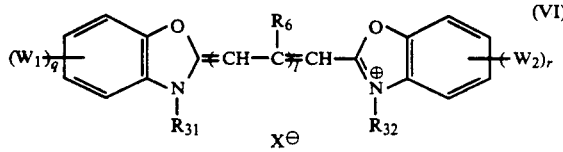

(VI)

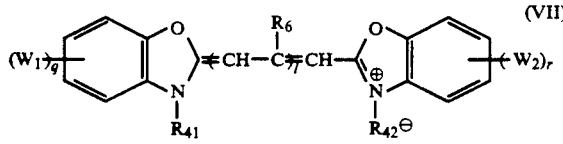

(VII)

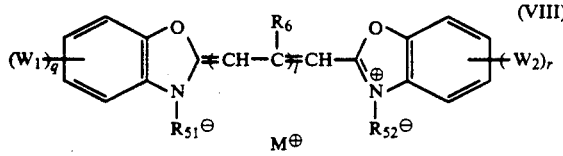

(VIII)

In formulae (III) to (VIII), l, $R_0$, $W_1$, $W_2$, $X^{\ominus}$, q and r have the same meaning as in formulae (I) and (II). $Y_3$ and $Y_4$ each represents sulfur atoms or selenium atoms. $R_{31}$, $R_{32}$ and $R_{41}$ represent alkyl groups with up to 4 carbon atoms. $R_{42}$, $R_{51}$ and $R_{52}$ represent dissociated sulfoalkyl groups or sulfoalkoxyalkyl groups (with up to 4 carbon atoms). $M^{\oplus}$ represents a hydrogen ion, an alkali metal ion, an ammonium ion or other such cation. $R_6$ represents a methyl group or an ethyl group. The ethyl group is preferred as the substituent group represented by $R_{31}$, $R_{32}$ and $R_{41}$, and an ω-sulfoalkyl group composed of a straight carbon chain, for example, the β-sulfoethyl group, γ-sulfopropyl group or δ-sulfobutyl group, is preferred for the substituent groups represented by $R_{42}$, $R_{51}$ and $R_{52}$. The ethyl group is preferred as $R_6$. Sulfur atoms are preferred as $Y_3$ and $Y_4$.

Specific examples of cyanine dyes which are useful in the present invention are given below.

Specific examples of dyes represented by formula (III) include:

3,3'-Diethyl-9-ethylthiacarbocyanine iodide,
3,3'-Diethyl-9-ethylnaphthothiacarbocyanine iodide,
5,5'-Dichloro-3,3'-diethyl-9-ethylthiacarbocyanine iodide,
5,5'-Dimethyl-3,3'-diethyl-9-ethylthiacarbocyanine iodide,
5,5'-Dimethoxy-3,3'-diethyl-9-ethylthiacarbocyanine iodide,
5,5'-Diphenyl-3,3'-diethyl-9-ethylthiacarbocyanine iodide,
5,5'-Dichloro-3,3'-diethylthiacyanine iodide,
5,5'-Diphenyl-3,3'-diethylthiacyanine iodide,
3,3'-Diethylnaphthocyanine iodide.

Although the iodine salts have been cited, the chlorides, bromides, perchlorates and p-toluenesulfonic acid salts thereof are also acceptable.

Specific examples of dyes represented by formula (IV) include:

5,5'-Dichloro-3-ethyl-3'-sulfopropylthiacyanine,
5,5'-Diphenyl-3-ethyl-3'-sulfopropylthiacyanine,
3-Ethyl-3'-sulfopropylnaphthothiacyanine,
5,5'-Dichloro-3-ethyl-3'-sulfopropyl-9-ethylthiacarbocyanine,
5,5'-Dimethyl-3-ethyl-3'-sulfopropyl-9-ethylthiacarbocyanine,
5,5'-Dimethoxy-3-ethyl-3'-sulfopropyl-9-ethylthiacarbocyanine,
5,5'-Diphenyl-3-ethyl-3'-sulfopropyl-9-ethylthiacarbocyanine.

Specific examples of dyes represented by formula (V) include:

5,5'-Dichloro-3,3'-disulfopropylthiacyanine,
5,5'-Diphenyl-3,3'-disulfopropylthiacyanine,
3,3'-Disulfopropylnaphthocyanine,
5,5'-Dichloro-3,3'-disulfoethyl-9-ethylthiacarbocyanine,
5,5'-Dimethyl-3,3'-disulfopropyl-9-ethylthiacarbocyanine,
5,5'-Dimethoxy-3,3'-disulfopropyl-9-ethylthiacarbocyanine,
5,5'-Diphenyl-3,3'-disulfoethyl-9-ethylthiacarbocyanine.

Specific examples of dyes represented by formula (VI) include:

5,5'-Dichloro-3,3'-diethyl-9-ethyloxacarbocyanine perchlorate,
5,5'-Dichloro-3,3'-diethyl-9-ethyloxathiacarbocyanine iodide,
5,5'-Dimethyl-3,3'-diethyl-9-ethyloxacarbocyanine iodide,
5,5'-Dimethyl-3,3'-diethyl-9-ethyloxathiacarbocyanine iodide,
5,5'-Dimethoxy-3,3'-diethyl-9-ethyloxacarbocyanine iodide,
5,5'-Dimethoxy-3,3'-diethyl-9-ethyloxathiacarbocyanine iodide,
5,5'-Diphenyl-3,3'-diethyl-9-ethyloxacarbocyanine p-toluenesulfonate,
5,5'-Diphenyl-3,3'-diethyl-9-ethyloxathiacarbocyanine p-toluenesulfonate.

Specific examples of dyes represented by formula (VII) include:

3-Propyl-3'-sulfopropyl-9-ethyloxacarbocyanine,
3-Propyl-3'-sulfopropyl-9-ethyloxathiacarbocyanine,
5,5'-Dimethyl-3-ethyl-3'-sulfoethyl-9-ethyloxacarbocyanine,
5,5'-Dimethyl-3-ethyl-3'-sulfoethyl-9-ethyloxathiacarbocyanine,
5,5'-Dimethoxy-3-ethyl-3'-sulfoethyl-9-ethyloxacarbocyanine,
5,5'-Dimethoxy-3-ethyl-3'-sulfoethyl-9-ethyloxathiacarbocyanine,
5,5'-Diphenyl-3-ethyl-3'-sulfoethyl-9-ethyloxacarbocyanine.

Specific examples of dyes represented by formula (VIII) include:

5,5'-Dimethyl-3,3'-disulfoethyl-9-ethyloxacarbocyanine,
5,5'-Dimethyl-3,3'-disulfoethyl-9-ethyloxathiacarbocyanine,
5,5'-Dimethoxy-3,3'-disulfoethyl-9-ethyloxacarbocyanine, 5,5'-Dimethoxy-3,3'-disulfoethyl-9-ethyloxathiacarbocyanine, 5,5'-Dimethoxy-3,3'-disulfopropyl-9-ethyloxacarbocyanine, 5,5'-Diphenyl-3,3'-disulfoethyl-9-ethyloxacarbocyanine.

The amount of cyanine dye added is an amount sufficient to effectively spectrally sensitize the silver halide photographic emulsion. This amount can vary over a wide range in accordance with various aspects of the emulsion but is normally within the range of from $1\times10^{-6}$ to $1\times10^{-2}$ mol per mol of silver halide, and the range of from $5\times10^{-5}$ to $2\times10^{-3}$ mol is particularly advantageous.

The process of dye adsorption to silver halide grains is given in detail in *Quantitative Determination of Crystal Habit of Silver Halide Grains through Its Influence on Dye Adsorption* by Tadaaki Tani, Journal of Imaging Science, Vol. 29, No. 5, pp. 165 to 170 (1985). According to this article, the state of adsorption is momentarily changing throughout the ripening process with dye molecules being repeatedly adsorbed and desorbed until the dye molecules gradually settle into the most stable state and attain a state of equilibrium. In the case of 3,3'-bis(4-sulfobutyl)-9-methylthiacarbocyanine, several hours are required to attain equilibrium when the ripening temperature is 40° C. The rate-determining step in the change in the adsorption state of the dye is desorption of the dye and the activating energy is 26 Kcal/mol. Thus, the change in the adsorption state of the dye rapidly increases with the ripening temperature and only a few minutes are required to attain an equilibrium state at 70° C. Thus, the $\phi_r$ varies with changes in the adsorption state of the dye. In this invention, it has been discovered that photosensitive materials with improved stability and reciprocity characteristics are obtained when varying the ripening conditions, from the time of the addition of the dye to the emulsion until the time of coating, by selecting conditions such that it assumes a value of $\frac{1}{2}$ or less and more preferably of $\frac{1}{3}$ or less that of the $\phi_r$ when ripening at 40° C. for 20 minutes.

In order to make the $\phi_r$ of $\frac{1}{2}$ or less of its value under ripening conditions of 40° C. for 20 minutes, it is effective to raise the ripening temperature or to increase the ripening time, but the condition adjustments are not limited to this. As one criterion, when ripening is carried out for 20 minutes, a ripening temperature of 50° C. or above will be effective, and it will be advantageous to carry out ripening preferably at 60° C. or above and more preferably at 70° C. or above. Furthermore, when carrying out ripening at 40° C., the ripening time will advantageously be 1 hour or more and preferably 4 hours or more.

These sensitizing dyes can be directly dispersed in the emulsion. Alternatively, they may be dissolved in a water-soluble solvent such as pyridine, methyl alcohol, ethyl alcohol, methyl cellosolve or acetone (or mixtures of solvents such as the above), in some cases diluted in water, and in some other cases dissolved in water. They can then be added to the emulsion in the form of such solutions. Ultrasonic vibrations can be used for this dissolution. Furthermore, as described, for example, in U.S. Pat. No. 3,469,987 (which is incorporated herein in its entirety by reference) it is possible to use a method in which the dye is dissolved in a volatile organic solvent, the solvent is dispersed in a hydrophilic colloid and the dispersion is added to the emulsion, or, as described, for example, in JP-B-46-24185 (the term "JP-B" as used herein refers to an "examined Japanese patent publication"), the method in which a water-insoluble dye is dispersed in a water-soluble solvent without being dissolved and this dispersion is added to the emulsion. Furthermore, the dye can be added to the emulsion in the form of a dispersion using an acid solution and dispersion method. In addition, the methods described, for example, in U.S. Pat. Nos. 2,912,345, 3,342,605, 2,996,287 and 3,425,835 can also be used for the addition to the emulsion.

The photographic emulsions sensitized by means of the present invention may contain sensitizing dyes other than the dyes represented by formulae (I) and (II) on substantially colorless compounds which are known to have a supersensitizing action, with the limitation that they do not impair the effect of the present invention. For example, they may contain compounds having a pyrimidinylamino group or a triazinylamino group as described, for example, in U.S. Pat. Nos. 2,933,390, 3,511,664, 3,615,613, 3,615,632 and 3,615,641 or an aromatic organic acid/formaldehyde condensate, azaindenes or cadmium salts as described in British Patent 1,137,580.

The heterocyclic compounds used in the present invention which have a mercapto group have at least one nitrogen atom and preferably have at least two nitrogen atoms in the hetero ring and have the following tautomeric thioamide groups.

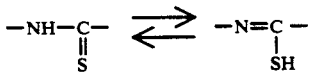

In addition to nitrogen atoms, the hetero ring may have hetero atoms such as oxygen atoms, sulfur atoms and selenium atoms. Advantageous compounds are single ring heterocyclic compounds having at least two 5-membered or 6-membered aza nitrogen atoms, or 2-ring or 3-ring heterocyclic compounds in which 2 or 3 hetero rings having at least one aza nitrogen atom have been condensed, and are compounds in which a mercapto group has been substituted onto the carbon atom neighboring the aza nitrogen atom.

In the nitrogen-containing heterocyclic compound having a mercapto group which is used in the present invention, it is possible to employ, as the hetero ring, a pyrazole ring, a pyrimidine ring, a 1,2,4-triazole ring, a 1,2,3-triazole ring, a 1,3,4-thiadiazole ring, a 1,2,3-thiadiazole ring, a 1,2,4-thiadiazole ring, a 1,2,5-thiadiazole ring, a 1,2,3,4-tetrazole ring, a pyridazine ring, a 1,2,3-triazine ring, a 1,2,4-triazine ring, a 1,3,5-triazine ring, rings in which 2 or 3 of these rings have been bound; examples include a triazolotriazole ring, a diazaindene ring, a triazaindene ring, a tetraazaindene ring and a pentaazaindene ring. It is also possible to employ hetero rings in which a single ring hetero ring and an aromatic ring have been bound; examples include a phthalazine ring, a benzimidazole ring, an indazole ring and a benzothiazole ring.

Of these rings, a 1,2,4-triazole ring, a 1,3,4-thiadiazole ring, a 1,2,3,4-tetrazole ring, a 1,2,4-triazine ring, a triazolotriazole ring and a tetraazaindene ring are preferred.

The mercapto group may be substituted onto any carbon atom in these rings, but preferred cases are those in which the following bonds are formed.

a) 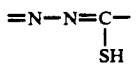

b) 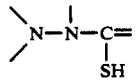

c) 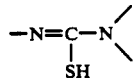

The hetero ring may have substituent groups other than the mercapto group. Examples of these substituent groups include alkyl groups with 8 or less carbon atoms (for example, methyl, ethyl, cyclohexyl and cyclohexylmethyl), substituted alkyl groups (for example, hydroxymethyl), alkoxy groups with 8 or less carbon atoms (for example, methoxy, ethoxy), alkylthio groups with 8 or less carbon atoms (for example, methylthio, butylthio), hydroxyl groups, amino groups, hydroxyamino groups, alkylamino groups with 8 or less carbon atoms (for example, methylamino and butylamino), dialkylamino groups with 8 or less carbon atoms (for example, dimethylamino and diisopropylamino), arylamino groups (for example, anilino), halogen atoms (for example, chlorine and bromine), cyano groups, sulfone groups, sulfoalkyl groups with 8 or less carbon atoms, carboxyl groups and carboxyalkyl groups with 8 or less carbon atoms.

Specific examples of compounds having mercapto groups which are used in the present invention are listed below. However, the present invention is not limited to these alone.

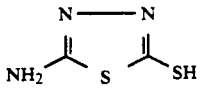

Compound (I)

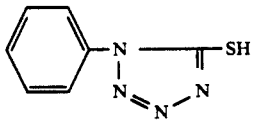

Compound (II)

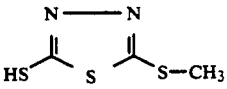

Compound (III)

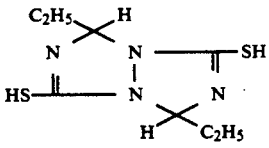

Compound (IV)

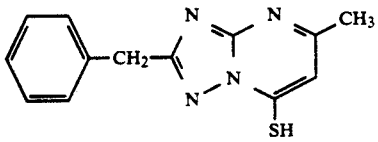

Compound (V)

-continued

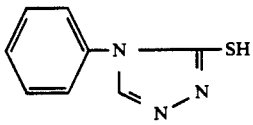

Compound (VI)

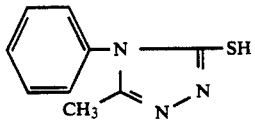

Compound (VII)

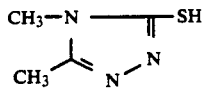

Compound (VIII)

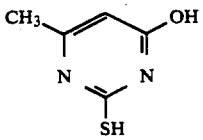

Compound (IX)

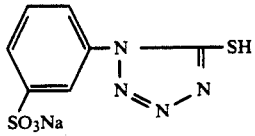

Compound (X)

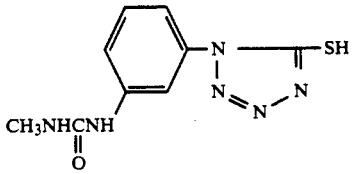

Compound (XI)

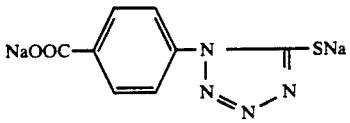

Compound (XII)

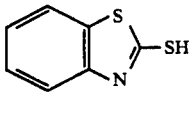

Compound (XIII)

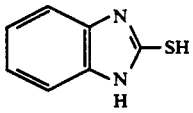

Compound (XIV)

The addition conditions and the amount of the heterocyclic compound having the mercapto group which is added should be sufficient to increase the $\phi_r$. The amount added and the conditions will vary over a wide range in accordance with such factors as the type of compound and the properties of the silver halide emulsion, but the amount of the heterocyclic compound having the mercapto group will be effective at a molar ratio of generally 0.1 to 10 times the amount of the sensitizing dye, preferably 1 to 10 times and more preferably 2 to 5 times. Regarding the time at which the heterocyclic compound having the mercapto group is added, it is effective to make the addition prior to the addition of the sensitizing dye mentioned above and this may be either during or after silver halide grain formation or before, during or after chemical ripening. Preferably, it is added after the silver halide grains have been formed and it is effective if the ripening temperature until the addition of the dye is generally 50° C. or more, preferably 60° C. or more and most preferably 70° C. or more while the ripening time is generally 3 minutes or more, preferably 10 minutes or more and most preferably 30 minutes or more.

Effective proportions (by weight) of the mercapto compound (i.e., heterocyclic compound containing a mercapto group) and the dye (i.e., the cyanine dye) represented by formula (I) are within the range of preferably 40/1 to 1/10 and, in particular, the range of 5/1 to 1/5 is particularly advantageous.

The characteristic of the present invention is in the selection of the ripening conditions from the time of the addition of the spectral sensitizing dye to the time of coating, which is to say the ripening time, in such a way that it gives a value for the $\phi_r$ which is ½ or less of value for the $\phi_r$ when ripening at 40° C. for 20 minutes after adding the dye to the same emulsion. But, in the determination of this ripening condition, it is essential that heterocyclic compounds having mercapto groups are not present in the emulsion.

Regarding emulsions in which heterocyclic compounds having mercapto groups are not present, the ripening conditions are determined in such a way that the value of the $\phi_r$ is ½ or less of that of $\phi_r$ under ripening conditions of 40° C., 20 minutes.

After having set the ripening conditions in this way, the effects of the present invention can be most markedly produced by further adding heterocyclic compounds having mercapto groups prior to the addition of the dye, also adding the dye and ripening under the set ripening conditions.

The photographic emulsions which have been sensitized using the present invention may also contain sensitizing dyes other than the dyes represented by formula (I) and substantially colorless compounds which are known to have a supersensitizing action, with the limitation that they do not impair the effect of the present invention. For example, they may contain compounds having a pyrimidinylamino group or triazinylamino group as described, for example, in U.S. Pat. Nos. 2,933,390, 3,511,664, 3,615,613, 3,615,632 and 3,615,641 or the aromatic organic acid/formaldehyde condensates, azaindenes or cadmium salts described in British Patent 1,137,580.

The photosensitive materials produced using photographic emulsions which have been sensitized by the method of the present invention may simultaneously have spectrally sensitized emulsion layers or nonspectrally sensitized emulsion layers other than the present invention, and it is possible to select the positional relationships in these photosensitive materials, if desired.

The silver halide in the photographic emulsions used with the method of the present invention may be, for example, silver chloride, silver bromide, silver iodide, silver chlorobromide, silver iodobromide, silver chloroiodobromide and the like. Silver bromide or silver iodobromide can be used to particular advantage.

Gelatin is normally used as a binder in the silver halide emulsions used in the present invention, but part or all of the gelatin may be replaced by a substance which does not have any harmful effect on the photosensitive silver halide such as gelatin derivatives, albumin, agar, gum arabic, alginic acid and the like, or polyvinyl alcohol, polyvinyl pyrrolidone, acrylic acid copolymers, polyacrylamide and other such hydrophilic resins or cellulose derivatives.

The silver halide emulsions used in the present invention may be coarse grained, fine grained or mixtures of these grains, and these silver halide grains are formed by a known method such as the single jet method, double jet method or controlled double jet method.

Moreover, the crystal structure of the silver halide grains may be uniform to the inside or of a laminar structure in which the inside and the outside are heterogeneous or it may be of the so-called conversion type as described in British Patent 635,841 and U.S. Pat. No. 3,622,318. Furthermore, the grains may be of the type in which the latent image forms mainly on the surface or of the internal latent image type in which it forms on the inside of the grain. These photographic emulsions are described in works such as *The Theory of the Photographic Process* by Mees (published by the Macmillan Co.) and *Photographic Chemistry* by Glafkides (published by the Fountain Press Co.), and they can be prepared by various methods such as the generally recognized ammonia method, neutral method or acidic method.

There is no particular limitation upon the average diameter of the silver halide grains used (for example, measured by the projected area method, numerical average), but it is preferably about 0.04 μm to about 2 μm. The grain size distribution ("grain size" denotes the same meaning as mentioned above) may be either broad or narrow.

The silver halide emulsion may or may not be physically ripened.

Emulsions which have not been chemically sensitized (so-called primitive emulsion) can be used as the silver halide emulsion but this may also be chemically sensitized. The methods described in the above-mentioned works of Mees and Glafkides or of Frieser and various other known methods can be used for the chemical sensitization method. Thus, it is possible to use, either singly or in combination, compounds which contain sulfur able to react with silver ions such as thiosulfates or the compounds described in U.S. Pat. Nos. 1,574,944, 2,278,947, 2,410,689, 3,189,458 and 3,501,313 and French Patent 2,059,245, and also the sulfur sensitization method which makes use of active gelatin; the gold sensitization which makes use of complex gold salts or complex gold thiosulfate salts and the like as described in U.S. Pat. No. 2,399,083; or a sensitization method which makes use of salts of noble metals such as platinum, palladium, iridium, rhodium and ruthenium as described in U.S. Pat. Nos. 2,448,060, 2,540,086, 2,566,245 and 2,566,263. Furthermore, it is possible to use the selenium sensitization method described in U.S. Pat. No. 3,297,446 instead of or together with the sulfur sensitization method.

The photographic emulsions sensitized according to the present invention may contain various compounds in order to prevent fogging during the production process or during storage or development processing of the photosensitive material or to stabilize the photographic performance. For example, it is possible to add azaindene compounds such as tetraazaindenes, and compounds as described in, for example, U.S. Pat. Nos. 2,444,605, 2,444,606, 2,450,397, JP-B-39-10166 and JP-B-42-10516; and pentaazaindenes, for example, the compounds described in U.S. Pat. No. 2,713,541 and JP-B-43-13495. Furthermore, it is also possible to add, for example, benzenesulfinic acid as described in U.S. Pat. No. 2,394,198 and benzenesulfinic acid amide as described in JP-B-43-4136. Furthermore, it is possible to add various chelating agents as described in U.S. Pat. No. 2,691,588, British Patent 623,488, JP-B-43-4941 and JP-B-43-13496 in order to prevent the occurrence of fogging caused by metal ions.

In order to increase sensitivity, raise contrast or accelerate development, the photographic emulsions which are sensitized by means of the present invention may contain, for example, the polyalkylene oxides described in U.S. Pat. No. 2,441,389, the ethers, esters and amides of polyalkylene oxide described in U.S. Pat. No. 2,708,161, and other polyalkylene oxide derivatives described in British Patent 1,145,186, JP-B-45-10989, JP-B-45-15188, JP-B-46-43435, JP-B-47-8106 and JP-B-47-8742; quaternary ammonium compounds described in U.S. Pat. No. 3,772,021; pyrrolidine and the like described in JP-B-45-27037; urethane or urea derivatives described in JP-B-40-23465; imidazole derivatives described in JP-B-47-45541; polymers described in JP-B-45-26471; and 3-pyrazolidones described in JP-B-45-27670.

Inorganic or organic mercury compounds may be added to the photographic emulsions of the present invention in order to increase speed or prevent fogging. By way of example, it is possible to use the complex mercury salts described in U.S. Pat. No. 2,728,664, benzothiazole mercury salts described in U.S. Pat. No. 2,728,667, mercury salt adducts described in U.S. Pat. Nos. 2,728,663 and 2,732,302, and organic mercury compounds described in U.S. Pat. Nos. 2,728,665 and 3,420,668.

The photographic emulsions sensitized according to the present invention can contain additives with a variety of functions in order to enhance the quality of the photographic material. Examples include film hardeners, coating aids, plasticizers, emulsified polymer latexes, antistatic agents, ultraviolet absorbers and antioxidants.

The photographic emulsions which have been sensitized by means of the present invention can be hardened by the addition of commonly used film hardeners. Examples include a variety of substances, either singly or in combination, for example, compounds with reactive halogens such as 2,4-dichloro-6-hydroxy-1,3,5-triazine described in U.S. Pat. No. 3,325,287, mucohalic acids such as mucobromic acid and mucochloric acid described in U.S. Pat. No. 2,080,019 and derivatives of the same described in JP-B-46-1872; bis(methanesulfonic acid ester) described in U.S. Pat. No. 2,726,162; sulfonyl compounds such as bis(benzenesulfonyl chloride) described in U.S. Pat. No. 2,725,295; divinylsulfones such as the compounds described in U.S. Pat. No. 2,579,871; compounds with a reactive olefin bond such as divinyl ketones such as the compounds described in West German Patent 872,153; inorganic film hardeners such as chrome alum or chrome acetate.

Various known surfactants can be added to photographic emulsions which have been sensitized according to the present invention as coating aids or for such purposes as static prevention and improving sliding properties. For example, it is possible to use nonionic surfactants including: saponin, polyethylene glycol, the polyethylene glycol/polypropylene glycol condensates described in U.S. Pat. No. 3,294,540, the polyalkylene glycol ether described in U.S. Pat. Nos. 2,240,472 and 2,831,766; polyalkylene glycol ester and polyalkylene glycol amide; anionic surfactants such as alkyl carboxylates, alkylsulfonates, alkylbenzenesulfonates, alkylnaphthalenesulfonates, alkyl sulfate esters, N-acyl-N-alkyl taurines as described in U.S. Pat. No. 2,739,891, maleopimarates as described in U.S. Pat. Nos. 2,359,980, 2,409,930 and 2,447,750, and the compounds described in U.S. Pat. Nos. 2,823,123 and 3,415,649; and amphoteric surfactants such as the compounds described in British Patent 1,159,825, JP-B-40-378, JP-A-48-43924 and U.S. Pat. No. 3,726,683.

Photographic emulsions sensitized by means of the present invention may contain plasticizers such as glycerine, the diols described in U.S. Pat. No. 2,960,404 and the trivalent aliphatic alcohols described in U.S. Pat. No. 3,520,694.

Photographic emulsions sensitized by means of the present invention can contain dispersions of synthetic polymers which are insoluble or sparingly soluble in water in order, for example, to improve the dimensional stability.

Furthermore, the substances described, for example, in JP-B-41-20389, JP-B-43-3504, JP-B-43-13168, U.S. Pat. Nos. 2,697,037, 3,423,207 and 2,865,752, British Patents 1,030,392 and 1,100,546 are used as irradiation preventing dyes which are included in accordance with the intended use.

Photographic emulsions spectrally sensitized by means of the present invention may contain commonly used nondiffusible color image forming couplers. "Color image forming coupler" refers to a compound which forms a dye by reacting with the oxidation products of primary aromatic amine developers during photographic development (referred to below as a coupler). The couplers may be 4-equivalent or 2-equivalent and may also be couplers which release development inhibitors or color compensating colored couplers. Acylaminoacetamide based and other such open chain ketomethylene compounds are used as effective yellow forming couplers; pyrazolone based or cyanoacetyl based compounds are used as effective magenta forming couplers; and naphtholic or phenolic compounds are used as effective cyan forming couplers. The couplers can be introduced into the photographic emulsion layers using methods which are commonly employed for multicolor photosensitive materials.

Examples of such couplers include: 4-equivalent or 2-equivalent diketomethylene based yellow couplers such as the compounds described in, for example, U.S. Pat. Nos. 3,277,157, 3,415,652, 3,447,928, 3,311,476 and 3,408,194, the compounds described, for example, in U.S. Pat. Nos. 2,875,057, 3,265,506, 3,409,439, 3,551,155, 3,551,156, West German Patent Applications (OLS) 1,956,281 and 2,162,899 and the compounds described, for example, in JP-A-47-26133 and JP-A-48-66836; 4-equivalent or 2-equivalent pyrazolone based magenta couplers and indazolone based magenta couplers such as the compounds described, for example, in U.S. Pat. Nos. 2,600,788, 2,983,608, 3,006,759, 3,062,653, 3,214,437, 3,253,924, 3,419,391, 3,419,808, 3,476,560, 3,582,322, JP-B-45-20636 and JP-A-47-26133; α-naphtholic cyan couplers and phenolic cyan couplers such as the compounds described, for example, in U.S, Pat. Nos. 2,474,293, 2,698,794, 3,034,892, 3,214,437, 3,253,924, 3,311,476, 3,458,315, 3,591,383, JP-B-42-11304 and JP-B-44-32461. In addition, it is also possible to use the DIR couplers and DIR compounds described, for example, in U.S. Pat. Nos. 3,227,554, 3,148,062, 3,297,445, 3,253,924, 3,311,476, 3,379,529, 3,516,831, 3,617,291, 3,705,801, 3,632,345, West German Patent Application (OLS) 2,163,811. The couplers can be dispersed by the method described, for example, in U.S. Pat. No. 2,801,171.

The photographic emulsions of the present invention can be coated onto supports by various known coating methods either alone or together with other hydrophilic colloid layers.

Coating methods include the dip coating method, the air knife coating method, the roller coating method, the curtain coating method and the extrusion coating method. The method described in U.S. Pat. No. 2,681,294 is one useful method. Furthermore, two or more layers may be coated simultaneously using, for example, a method as described in U.S. Pat. Nos. 2,761,791 and 3,526,528.

Any known method can be used for the photographic processing of the photographic emulsions of the present invention. Known substances can be used in the processing baths and any temperature can be used for the processing temperature; a temperature lower than 18° C., a temperature of 18° C. to 50° C. or in excess of 50° C.

According to the intended use, both development processing for forming a silver image (black-and-white photographic processing), and color photographic processing comprising development processing for forming a dye image, can be applied to the photosensitive materials of the present invention. The present invention is explained in further detail below by means of examples.

Preferred embodiments of the present invention are as follows:

(1) A spectral sensitization method in which a cyanine dye which provides a J-band is added and then ripening is carried out at a temperature of 60° C. or more.

(2) The method in (1) above in which ripening is carried out at 70° C. or more.

(3) The method in (1) or (2) above in which a heterocyclic compound having a mercapto group is added prior to the addition of the cyanine dye.

(4) A spectral sensitization method in which a heterocyclic compound having a mercapto group is added after silver halide grain formation, ripening is carried out at 50° C. or more for 3 minutes or more and ripening is then again carried out at a temperature of 60° C. or more after adding a cyanine dye which provides a J-band.

EXAMPLE 1

A 1N $AgNO_3$ aqueous solution and a 1N KBr aqueous solution were simultaneously added to an aqueous gelatin solution containing 1.25 g/liter of $NH_3$ using the common CDJ method (controlled double jet method). The silver potential during the reaction was maintained at −40 mV, thereby preparing an emulsion consisting of octahedral AgBr grains with a grain size (sphere equivalent diameter of the projected surface area) of 0.87 μm. 0.77 mol of AgBr was contained in 1 liter of the emulsion, the pH was 6.35, and the pAg was 8.94.

Five ml aliquots of a 0.16% by weight methanol solution of Dye (1), with the structure shown below, were added to 95 ml extracts from the above-mentioned emulsion; one sample was ripened at 40° C. for 20 minutes, while another was ripened at 70° C. for 20 minutes, and then they were coated onto a TAC film base (support) and $\phi_r$ was measured by a common method as described in J. Spence and B. H. Carroll, *J. Phys. Colloid Chem.*, Vol. 52, p. 1090 (1948) and T. Tani and Urabe, *J. Soc. Photogr. Sci. Tech., Japan*, Vol. 41, p. 325 (1978).

Dye (1)

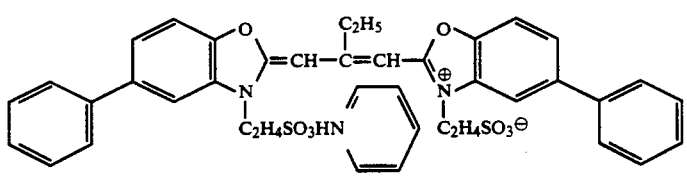

The measurement results are given in Table 1.

TABLE 1

| Test | Grain | Dye | Ripening Conditions | $\phi_r$ | λmax (nm) |
|---|---|---|---|---|---|
| 1 (Comparison) | Octahedral | (1) | 40° C., 20 min. | 0.84 | 535 |
| 2 | " | " | 70° C., 20 min. | 0.21 | 549 |

The maximum absorption wavelength of the J-band in the sample of Test 2 was longer than that in the sample of Test 1 and it will be seen that the J aggregates had grown large. The $\phi_r$ in the sample of Test 2 was smaller than that in the sample of Test 1, but the dye adsorption was increased, thereby obtaining an emulsion which is extremely stable over time.

EXAMPLE 2

Predetermined amounts of methanol solutions of $1\times10^{-2}$ mol/liter of the previously identified Mercapto Compounds (XIII), (XIV), (II), (III), (VI) and (VII) were added to 95 ml extracts of the octahedral AgBr emulsion prepared in Example 1 while maintaining at 70° C. and stirring well.

After maintaining the above emulsion at 70° C. and stirring for 20 minutes, 5 ml of a 0.16% by weight methanol solution of Dye (1) were added. After further stirring for 20 minutes at 70° C., this was coated onto a TAC film base and the $\phi_r$ was measured by the common method (same as in Example 1). The measurement results are given in Table 2.

TABLE 2

| | | (70° C., 20 minutes) Mercapto Compound | | | | |
|---|---|---|---|---|---|---|
| Test | Grain | Type | Amount Added (ml) | Dye | $\phi_r$ | J Aggregate λmax (nm) |
| 3 | Octahedral | (XIII) | 3 | (1) | 0.28 | 548 |
| 4 | " | (XIV) | 3 | (1) | 0.69 | 548 |
| 5 | " | (II) | 3 | (1) | 0.68 | 549 |
| 6 | " | (III) | 3 | (1) | 0.66 | 553 |
| 7 | " | (VI) | 10 | (1) | 0.82 | 547 |
| 8 | " | (VII) | 1 | (1) | 0.65 | 548 |

A comparison with Table 1 reveals that the addition of the mercapto compounds increases the $\phi_r$ markedly without greatly changing the maximum absorption wavelength λmax of the J aggregates. Thus, this produces a spectrally sensitized emulsion with a high $\phi_r$ in which the dye adsorption is strong and in which the stability over time is enhanced.

EXAMPLE 3

Five ml aliquots of a 0.16% by weight methanol solution of Dye (1) were added to 95 ml extracts of the octahedral AgBr emulsion prepared in Example 1 while maintaining at 70° C. This was then stirred for 5 minutes, and 1 ml of an aqueous solution of 0.01% by weight of sodium thiosulfate was added for sulfur sensitization. After stirring for a further 15 minutes, this was coated onto a TAC film base, and the $\phi_r$ was measured by the common method (same as in Example 1). Furthermore, in the above tests measurements were taken of the $\phi_r$ of a sample prepared by adding 3 ml of a methanol solution of $1\times10^{-2}$ mol/liter of Mercapto Compound (II) 20 minutes before the addition of Dye (1). The measurement results are shown in Table 3.

TABLE 3

| Test | Grain | Mercapto Compound Type | Mercapto Compound Amount Added (ml) | Dye Type | Dye Amount Added (ml) | Sodium Thiosulfate (ml) | $\phi_r$ |
|---|---|---|---|---|---|---|---|
| 9 | Octahedral | (II) | 0 | (1) | 5 | 1 | 0.04 |
| 10 | Octahedral | (II) | 3 | (1) | 5 | 1 | 0.62 |

A comparison of Samples 1 and 9 reveals that the $\phi_r$ of the emulsion for which sulfur sensitization had been carried out at 70° C. is small but dye adsorption is strong and it is outstanding in its age stability. Moreover, it proved possible to obtain a spectrally sensitized and sulfur sensitized emulsion with a high $\phi_r$ in which dye adsorption was strong and age stability was enhanced by adding Compound (II) in Test 10 prior to the addition of the dye.

EXAMPLE 4

An emulsion consisting of cubic AgBr grains with a grain size of 0.82 μm was prepared by maintaining the silver potential at +60 mV during the reaction during the preparation of an emulsion in the same way as in Example 1.

Five ml aliquots of a 0.16% by weight methanol solution of Dye (2), which has the following structure, were respectively added to 95 ml extracts from the cubic AgBr emulsion mentioned above and from the octahedral AgBr emulsion of Example 1. These were respectively ripened at 40° C., 60° C. and 70° C. and 20 minutes and then coated onto a TAC film base and the $\phi_r$ was measured by the common method (same as in Example 1).

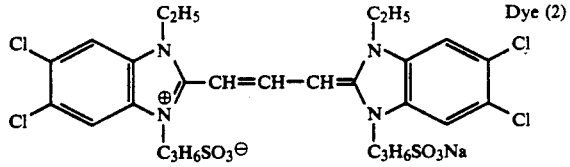

The measurement results are shown in Table 4.

TABLE 4

| Test | Grain | Dye | Ripening | $\phi_r$ 530 nm | $\phi_r$ 561 nm | λmax (nm) |
|---|---|---|---|---|---|---|
| 11 (Comparison) | Octahedral | (2) | 40° C., 20 min | 0.41 | 0.34 | 575 |
| 12 (Invention) | " | " | 60° C., 20 min | 0.09 | 0.07 | 577 |
| 13 (Invention) | " | " | 70° C., 20 min | 0.04 | 0.04 | 578 |
| 14 (Comparison) | Cubic | (2) | 40° C., 20 min | 0.50 | 0.46 | 568 |
| 15 (Invention) | " | " | 60° C., 20 min | 0.18 | 0.12 | 576 |
| 16 (Invention) | " | " | 70° C., 20 min | 0.16 | 0.13 | 577 |

It will be seen that the samples of the present invention had a longer dye J-band maximum absorption wavelength as compared with the comparative examples and that the J aggregates had grown large. In the present invention, the $\phi_r$ was smaller than in the comparative examples but this produced an emulsion which is extremely stable over time and in which dye adsorption was strong.

EXAMPLE 5

2.5 ml aliquots of a 0.16% by weight methanol solution of Dye (2) were added to 95 ml extracts of the cubic AgBr emulsion prepared in Example 4 while maintaining at 70° C. and this was then stirred for 5 minutes. The optimum amount of a 0.01% by weight aqueous solution of sodium thiosulfate was added for sulfur sensitization and, after stirring for a further 15 minutes, this was coated onto a TAC film base and the $\phi_r$ was measured by the common method (same as in Example 1). Furthermore, in the above tests measurements were also taken of the $\phi_r$ of a sample prepared by adding 3 ml of a $1\times10^{-2}$ mol/liter methanol solution of Compound (II) 20 minutes before the addition of Dye (2). The measurement results are shown in Table 5.

TABLE 5

| Test | Grain | Mercapto Compound Type | Mercapto Compound Amount Added (ml) | Dye Type | Dye Amount Added (ml) | Sodium Thiosulfate (ml) | $\phi_r$ |
|---|---|---|---|---|---|---|---|
| 17 | Octahedral | (II) | 0 | (2) | 2.5 | 1 | 0.10 |
| 18 | Octahedral | (II) | 3 | (2) | 2.5 | 4 | 0.34 |

A comparison of Tests 11 and 17 shows that the $\phi_r$ was lower in the emulsion which had been sulfur sensitized at 70° C. but that stability over time was enhanced and dye adsorption was strengthened. Moreover, it proved possible to obtain a spectrally sensitized and sulfur sensitized emulsion with a high $\phi_r$ and with excellent age stability and strong dye adsorption by adding Compound (II) in Test 18 prior to the addition of the dye.

EXAMPLE 6

Ten ml aliquots of a 0.16% by weight methanol solution of Dye (2) were added to 95 ml extracts of the octahedral AgBr emulsion prepared in Example 1, this was ripened at 70° C. for 20 minutes and then coated onto a TAC film base. The $\phi_r$ was measured by the common method (same as in Example 1). In the above test, samples were prepared by adding 3 ml of $1\times10^{-2}$ mol/liter methanol solutions of Compound (II) 3 minutes, 10 minutes and 30 minutes prior to the addition of Dye (2) and the $\phi_r$ was measured. Measurement results are shown in Table 6.

A comparison of Tests 11 and 19 shows that the $\phi_r$ was small in the emulsion ripened at 70° C. but that age stability was enhanced and dye adsorption was strengthened. Moreover, in Tests 20, 21 and 22, it proved possible to improve the $\phi_r$ by adding Compound (II) before the addition of the dye. The improvement in the $\phi_r$ was greater the longer the ripening time after the addition of Compound (II).

TABLE 6

| | | Mercapto Compound | | | Dye | | |
|---|---|---|---|---|---|---|---|
| Test | Grain | Type | Amount Added (ml) | Ripening Time (min) | Type | Amount Added (ml) | $\phi_r$ |
| 19 | Octahedral | (II) | 0 | — | (2) | 10 | 0.02 |
| 20 | Octahedral | (II) | 10 | 30 | (2) | 10 | 0.15 |
| 21 | Octahedral | (II) | 10 | 10 | (2) | 10 | 0.07 |
| 22 | Octahedral | (II) | 10 | 3 | (2) | 10 | 0.04 |

EXAMPLE 7

Predetermined amounts of a $1\times10^{-2}$ mol/liter methanol solution of Compound (X) were added to 95 ml extracts of the octahedral AgBr emulsion prepared in Example 1, and ripening was carried out at 70° C. for 20 minutes. Following this, 5 ml of a 0.16% by weight methanol solution of Dye (2) were added while stirring at 70° C. After 5 minutes, a predetermined amount of a 0.01% by weight aqueous solution of sodium thiosulfate was added for sulfur sensitization. After ripening for a further 15 minutes, this was coated onto a TAC film base and the $\phi_r$ was measured by the common method (same as in Example 1). The measurement results are shown in Table 7.

TABLE 7

| | | Mercapto Compound | | Dye | | Sodium | |
|---|---|---|---|---|---|---|---|
| Test | Grain | Type | Amount Added (ml) | Type | Amount Added (ml) | Thiosulfate (ml) | $\phi_r$ |
| 23 | Octahedral | (X) | 0 | (2) | 5 | 2 | 0.02 |
| 24 | Octahedral | " | 1 | " | 5 | 4 | 0.06 |
| 25 | Octahedral | " | 3 | " | 5 | 8 | 0.36 |

TABLE 7-continued

| | | Mercapto Compound | | Dye | | Sodium | |
|---|---|---|---|---|---|---|---|
| Test | Grain | Type | Amount Added (ml) | Type | Amount Added (ml) | Thiosulfate (ml) | $\phi_r$ |
| 26 | Octahedral | " | 10 | " | 5 | 16 | 0.26 |

A comparison of Tests 11 and 23 shows that the $\phi_r$ was small in the emulsion which had been sulfur sensitized and ripened at 70° C. but that the age stability was enhanced and dye adsorption was strengthened. Moreover, in tests 24, 25 and 26, it proved possible to improve the $\phi_r$ by adding Compound (X) before the addition of the dye.

EXAMPLE 8

The same tests were carried out using the Compound (XI) instead of Compound (X) in Example 7. Measurement results are shown in Table 8.

TABLE 8

| | | Mercapto Compound | | Dye | | Sodium | |
|---|---|---|---|---|---|---|---|
| Test | Grain | Type | Amount Added (ml) | Type | Amount Added (ml) | Thiosulfate (ml) | $\phi_r$ |
| 27 | Octahedral | (XI) | 0 | (2) | 5 | 2 | 0.02 |
| 28 | Octahedral | " | " | " | " | 4 | 0.03 |
| 29 | Octahedral | " | 1 | " | " | 2 | 0.07 |
| 30 | Octahedral | " | " | " | " | 4 | 0.08 |
| 31 | Octahedral | " | 3 | " | " | 8 | 0.34 |
| 32 | Octahedral | " | " | " | " | 16 | 0.33 |

A comparison of Tests 11 with 27 and 28 shows that the $\phi_r$ was small in the emulsion which had been chemically sensitized and ripened at 70° C. but that the age stability was enhanced and the dye adsorption was strengthened. Moreover, in tests 29 to 32, it also proved possible to improve the $\phi_r$ by adding Compound (XI) before the addition of the dye.

While the invention has been described in detail and with reference to specific embodiments thereof, it will be apparent to one skilled in the art that various changes and modifications can be made therein without departing from the spirit and scope thereof.

What is claimed is:

1. A method for spectrally sensitizing a silver halide emulsion comprising the steps of:

adding a heterocyclic compound containing a mercapto group to an emulsion in an amount sufficient to increase the $\phi_r$, said heterocyclic compound containing one of the following as a partial structure:

a) $=N-N=\underset{\underset{SH}{|}}{C}-$ and

-continued b) 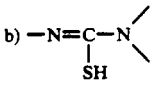 , and subsequently adding a cyanine dye, which provides a J-band when added to silver halide emulsions, to the silver halide emulsion under a ripening temperature of 60° C. or above and such other conditions such that in the absence of said heterocyclic compound the relative quantum yield $\phi_r$ of spectral sensitization would assume a value of ½ or less of the $\phi_r$ of spectral sensitization obtained when the dye is added to the emulsion under ripening conditions of 40° C. and 20 minutes from the time of the addition of the dye to the emulsion until the time of coating the emulsion.

2. The method for spectrally sensitizing silver halide emulsions as in claim 1, wherein said cyanine dye is present in the emulsion in an amount of $1\times10^{-6}$ to $1\times10^{-2}$ mol per mol of silver halide.

3. The method for spectrally sensitizing silver halide emulsions as in claim 1, wherein the cyanine dye is present in the emulsion in an amount within the range of $5\times10^{-5}$ to $2\times10^{-3}$ mol per mol of silver halide.

4. The method for spectrally sensitizing silver halide emulsions as in claim 1, wherein the ripening conditions are 60° C. or above and 20 minutes or longer.

5. The method for spectrally sensitizing silver halide emulsions as in claim 1, wherein the ripening conditions are 70° C. or above and 20 minutes or longer.

6. The method for spectrally sensitizing silver halide emulsions as in claim 1, wherein the heterocyclic ring of said heterocyclic compound containing a mercapto group is a 1,2,4-triazole, 1,3,4-thiadiazole, 1,2,3,4-tetrazole, 1,2,4-triazine, triazolotriazole or tetraazaindene ring.

7. The method for spectrally sensitizing silver halide emulsions as in claim 1, wherein said relative quantum yield $\phi_r$ of spectral sensitization in the absence of said heterocyclic compound assumes a value of ⅓ or less of the $\phi_r$ of spectral sensitization obtained when the dye is added to the emulsion under ripening conditions of 40° C. and 20 minutes.

8. The method for spectrally sensitizing silver halide emulsions as in claim 1, wherein said heterocyclic compound containing a mercapto group is contained in the emulsion at a molar ratio of from 0.1 to 10 times the amount of the cyanine dye.

9. The method for spectrally sensitizing silver halide emulsions as in claim 1, wherein the proportion of said heterocyclic compound containing a mercapto group/-said cyanine dye is from 40/1 to 1/10 by weight.

10. The method for spectrally sensitizing silver halide emulsions as in claim 1, wherein said heterocyclic compound contains the following as a partial structure:

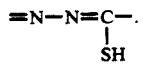

11. The method for spectrally sensitizing silver halide emulsions as in claim 1, wherein said heterocyclic compound contains the following as a partial structure:

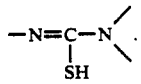

* * * * *